United States Patent [19]

Levasseur et al.

[11] 4,254,857

[45] Mar. 10, 1981

[54] DETECTION DEVICE

[75] Inventors: Joseph L. Levasseur, Chesterfield; William A. Seiter, St. Louis County; Calvin J. Christensen, Jefferson County, all of Mo.

[73] Assignee: H. R. Electronics Company, High Ridge, Mo.

[21] Appl. No.: 942,534

[22] Filed: Sep. 15, 1978

[51] Int. Cl.[3] ..... G07F 3/02

[52] U.S. Cl. ..... 194/100 A; 73/163

[58] Field of Search ..... 194/97 R, 100 R, 100 A; 73/163

[56] References Cited

U.S. PATENT DOCUMENTS

| | | | |
|---|---|---|---|
| 3,599,771 | 8/1971 | Hinterstocker | 194/100 A |
| 3,901,368 | 8/1975 | Klinger | 194/100 A |
| 4,124,111 | 11/1978 | Hayashi | 194/100 A X |

*Primary Examiner*—Joseph J. Rolla

*Attorney, Agent, or Firm*—Haverstock, Garrett & Roberts

[57] ABSTRACT

A detector device adapted to be used for detecting coins and other metal objects for various purposes including to distinguish between genuine and non-genuine or counterfeit coins, the subject detector device includes an electric tank circuit having a coil through which, or adjacent to which, an object or coin to be detected moves, apparatus to electrically shock the tank circuit to produce an output representative of the object or coin and represented as a damped wave signal the frequency and shape of which depends on the electrical characteristics associated with the tank circuit and on the physical and electric characteristics of an object or coin being detected, and a detector circuit operatively connected to the tank circuit including circuit elements connected to respond to one or more characteristics of the damped wave output. The detector circuit may optionally include circuit elements connected to respond to the shape of the envelope of the output, the number of cycles of the output that exceed some predetermined value, the time required for a number of cycles that exceed some preselected value to take place and/or to pronounced changes that occur in the shape of the envelope such as to a marked change in the rate of decline of the damped wave output. The present detector device optionally may also include other circuitry operatively connected thereto to modify the shape of the envelope, to establish time spaced electrical shocks of the tank circuit, to count cycles of the damped wave output that exceed some preselected value, and the device may include a cycle counter apparatus, a decoder circuit, and/or an apparatus actuatable in response to the occurrence of one or more predetermined parameters of the damped wave that are used to distinguish between objects that differ from one another in some one or more respects.

30 Claims, 18 Drawing Figures

DRIVER
DIVIDE BY TWO
CLOCK
RESET
INH

DETECTION DEVICE

There are many known metal and coin detector devices and circuits including sensing devices and systems that are able to distinguish between genuine and non-genuine or counterfeit coins. Typical of these is the detector device disclosed in co-pending Levasseur U.S. Pat. No. 4,151,904, issued May 1, 1979.

Among the various devices that are used to test or detect and to distinguish between valid or genuine objects or coins and counterfeit of non-genuine objects or coins or slugs are validating or detecting devices that respond to the diameter, thickness and other physical characteristics of the object or coin to determine if a coin is within acceptable dimensional limitations. Such devices are relatively crude, highly unreliable and are incapable of distinguishing between similar size objects or coins, even between similar size objects or coins that may show different amounts of wear. There are many reasons for this including the fact that coin size changes with use and other conditions. Other devices that perform tests for some purpose such as to determine genuiness include devices that respond to the serrations on coin, devices that test to see if there are any holes or other obvious imperfections due to damage or otherwise, devices that test as to coin weight, and devices that make certain tests on the rims of coins. These and other mechanical type testing devices suffer from any of the same shortcomings as the dimensional testing devices mentioned above.

There are other known detector devices that generate eddy currents in the objects or coins under test as they travel down the rail or chute through a magnetic or other field. Such devices may include means that respond to the back electromagnetic force (EMF) produced in the coin or object which is a force that varies in proportion to the conductivity of the metal in the object or coin. The back EMF may also cause a proportionate slowing down of the object or coin during the time it is traveling past the detector, and in some devices this change is made use of to cause the object or coin to prescribe an arc or some other movement in space during or after leaving the rail or chute. This effect is in relation to the metal content or conductivity of the object. Eddy current detector devices for the most part, however, are incapable of distinguishing between different objects or coins that are very similar to each other in certain respects.

There are still other known detector devices including those that detect by means that respond to or compare frequency responses and changes therein produced when a coin or other object is moving adjacent to a tunable circuit such as adjacent to an electric tank circuit, but none of these so far as known tests by detecting or looking at certain characteristics of a damped wave as distinguished from other forms of responses generated in the object or coin and none includes means for shocking a tank circuit when the object or coin is in the field thereof.

The various detector devices described above are relatively inaccurate, unsuitable or unreliable to distinguish between certain coins and slugs and especially between coins and slugs that have very similar physical and metallic characteristics. Because of this the making and selling of slugs for the purpose of cheating vending and other coin controlled devices and machines is fairly common and often lucrative and, has resulted in substantial losses to vending machine owners or operators. This situation has taxed the ingenuity of the vending industry and is further aggrevated by the fact that certain coins including certain foreign and domestic coins may have different monetary values but are close to each other in other respects such as in size, metal content and other characteristics, and it is important to be able to distinguish and identify these to prevent loses due to cheating and otherwise. Even the most sophisticated known detectors are not capable of distinguishing between similar objects such as between similar genuine and counterfiet coins and between similar genuine foreign and domestic coins.

In addition, to the devices discussed above, other electronic devices and detectors have been used with varying degrees of success. Several such devices are disclosed in U.S. Pat. Nos. 3,952,851 and 3,966,034. These devices employ inductors of known characteristics as part of an oscillator circuit. In these devices, an inductor is positioned to be affected by the presence of a coin in the vicinity thereof and to cause a change to occur in the oscillator output. Such changes have been used as a basis to distinguish between objects such as between genuine and non-genuine U.S. and foreign coins. The prior art devices disclosed in these patents make use of comparator circuits, frequency discriminating devices, and other means, and they require the presence of some standard of known characteristics be used in making the required comparison none of which are required by the present device. All of the known devices, have certain limitations and shortcomings that make them unsuitable and unreliable for distinguishing between similar objects such as between certain similar, but different coins.

The present invention represents a new approach to coin and metal detection and employs means and methods not heretofore used. The present construction employs an inductor device that is pulsed or shocked usually on some established time schedule that can be made to be very rapid in relation to the speed of movement of the coin therethrough to produce a plurality of momentary oscillating conditions in the form of damped waves. This can be done by interrupting the connection of the inductor of a tank type circuit to generate a series of time spaced damped wave output pulses or shocks. The damped wave produced by each such shock of the oscillator circuit has certain distinctive characteristics of magnitude, frequency and envelope shape depending on the object or coin that is in the field of the inductor and its position in the field and these characteristics are made use of in the present detector device. Furthermore, many different kinds of objects can be detected by the subject means including many kinds of metal devices, including coins, metal containers, and metal parts of many kinds.

The damped waves that are produced for each different type of object or coin are distinctively different from the damped waves that are produced for all other objects and coins. Furthermore, each damped wave has an envelope formed by succeeding oscillation cycles, wherein each succeeding cycle has a lesser voltage amplitude excursion than the preceding cycle until the amplitude of the wave decreases to zero or close to zero amplitude. The frequency of the signal that forms the damped wave may also be different for different objects or coins, and the rate of decline in amplitude of the wave effects the shape of the wave envelope and depends on the time constant of the associated circuitry and on the metal content, impedence, and physical characteristics of the object that produced the damped wave. The present invention is not only directed to producing damped wave signals but also includes means for use in detecting one or more specific characteristics of the damped waves such as the number of cycles that exceed some predetermined magnitude, sudden or marked changes that occur in the shape of the envelope, the time required for those cycles that exceed some predetermined value to occur, and other characteristics including for example, the width of the last counted cycle of the damped wave. This information can then be used to identify or distinguish different objects of coins. Some forms of the present device may also include auxiliary means to modify in various ways the shape of the damped wave envelope to provide yet other distinctive parameters. Any one or more of these characteristics may be used in the identifying or detecting process, and with the present device it is possible to produce numerous reoccurrences of a damped wave in a very short time interval so that as the object being detected moves through or adjacent to the field of the inductor many similar tests of the object can be made, and it is possible to select only those tests, or only those damped waves, that occur when the object is in the most desirable position relative to the inductor to control whether to accept or reject a particular coin or object or to determine whether the coin or object meets certain criteria for establishing acceptability or for some other purpose.

It is therefore a principal object of the present device to provide accurate and reliable means for distinguishing between and identifying objects such as coins that may be very similar to one another in size, shape and metal content but different from each other in some important respect.

Another object is to make use of one or more characteristics of a damped wave produced by a pulse oscillator circuit to distinguish between objects such as between coins and the like.

Another object is to provide means to establish a train of damped wave pulses, the characteristics of which vary depending upon the characteristics of an object such as a coin as it moves in or through the field of an inductor associated with an oscillator circuit.

Another object is to make use of the damped wave characteristics of a pulsed oscillator circuit in a metal detecting device.

Another object is to reduce cheating from vending machines.

Another object is to make it unprofitable to manufacture and market non-genuine or counterfeit coins and slugs.

Another object is to provide means to modify the shape of the envelope of a damped wave in order to produce distinctive envelope characteristics representative of certain objects such as certain coins and the like.

Another object is to be able to distinguish between objects such as coins and the like without having to make a comparison or use a standard.

Another object is to provide relatively simple and inexpensive means to identify unacceptable coins deposited in a vending or like machine.

Another object is to establish a distinctive parameter for use in identifying each different kind of coin that can be deposited in a vending or like machine.

These and other objects and advantages of the present invention will become apparent after considering the following detailed specification in conjunction with the accompanying drawings, wherein.

Figure 1:
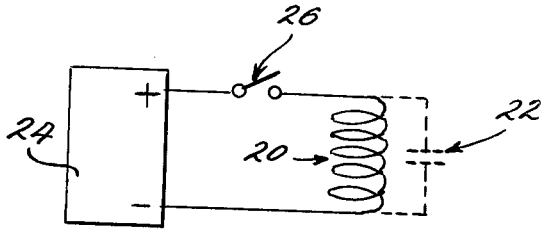
FIG. 1 is a simplified circuit diagram of an oscillator circuit for a coin detector constructed according to the present invention.
Figure 2:
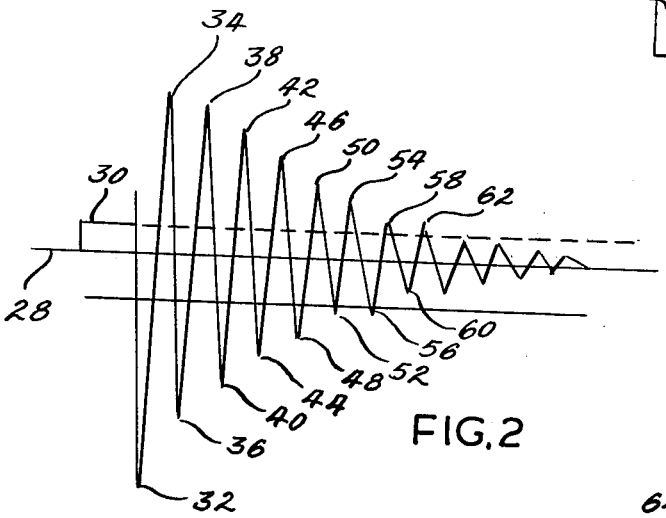
FIG. 2 is a graph of the damped wave form present across the inductor shown in FIG. 1 when no coin or other object is present in the field thereof.

Referring to the drawings more particularly by reference numbers, number 20 in FIG. 1 identifies an inductor or coil having distributed capacitance 22 between the adjacent convolutions thereof. The capacitance is shown in dotted outline. A capacitor can also be connected across the inductor if desired. The inductor 20 is connected across a voltage supply 24 through switch 26. When the switch 26 is closed the distributed capacitance 22 and the inductor 20 are charged by the supply voltage 24. Thereafter, when the switch 26 is reopened, the collapsing field of the inductor 20 and the discharging of the distributive capacitance 22 produce a so called ringing or shock effect such as is illustrated by the damped wave shown in FIG. 2. In FIG. 2 point 28 represents the zero voltage level and the potential at dotted line 30 represents the voltage of the supply voltage source 24. At the instant when the switch 26 is open the first excursion or alternation in the voltage across the inductor coil 20 is caused to occur by the collapsing of the inductive field thereacross. This initially drives the voltage across the inductor 20 downwardly to point 32. Thereafter, subsequent excursions of the damped wave produce oscillations which extend back and forth between points 34 and 62 and even beyond until the voltage collapses to zero voltage. In FIG. 2, the line 30 that represents the voltage level of the power supply 24 is used as an arbitrary voltage level to detect those upward excursions of the damped wave that go more positive than the supply potential 30. It can be seen that the excursions at points 34, 38, 42, 46, 50, 54, 58 and 62 each qualify and provide a total of 8 positive excursions that exceed the supply voltage. After the eighth excursion the magnitude of all succeeding excursions is less than the magnitude of the supply voltage and are therefore not counted. If the reference voltage is selected to be different than the supply voltage, the resultant number of excursions that exceed the selected voltage level will change. This is true whether the reference voltage level is increased or decreased. For example, if the reference voltage level is increased the number of cycles or excursions that exceed it will decrease while if the reference voltage level is decreased the number of excursions that exceed it will increase.

Figure 3:
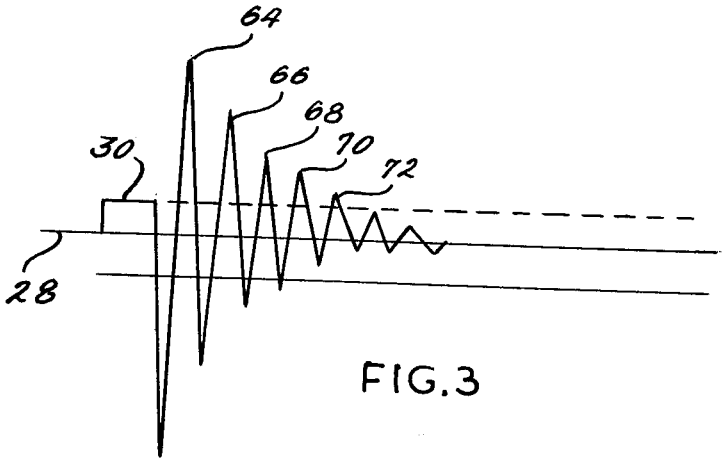
FIG. 3 is a graph of the damped wave form present across the inductor of FIG. 1 when a coin is present in the field thereof.

The graph in FIG. 3 is similar to the graph of FIG. 2 but differs therefrom primarily because it depicts the damped wave from across the inductor 20 when a coin or other object is present in the field of the inductor. When a coin is present the number of excursions that exceed the voltage level of the power supply 24 at 30 is shown reduced from the 8 shown in FIGS. 2 to 5. These are designated as the upward excursions 64, 66, 68, 70, and 72. It is significant also that the wave form when a coin is present is damped more rapidly than when no coin is present and this is an important difference, and is due mainly to the fact that the coin or other metal object reduces the effective impedance across the inductor. This fact is made use of in some forms of the present invention as will be explained.

The inductor 20 and its distributed capacitance 22 determine the frequency of the wave that is produced, and when a coin enters the field of the inductor 20 it changes the effective circuit inductance to some extent because the inductance for an air core coil is different than when a metal object is in its field. The coin also affects the overall effective circuit capacitance. Furthermore, the inductance and resistance of the coil 20 affects the duration of each damped wave. The presence of a coin in the field of the inductor coil 20 therefore substantially changes the shape of the damped wave envelope that is produced as is clearly shown by comparing FIGS. 2 and 3. The difference in the damped waves that are produced by different but similar coins may be very small as in the case of certain similar coins and slugs, yet these small differences are detected by the present device and enable it to distinguish between them. As will be explained hereinafter, the combination of amplitude clamping of the damped wave and the provision of a resistor-capacitor network can be utilized to significantly increase or amplify the relative differences between two adjacent alternations of a damped wave, and this can be made use of to provide a greater tolerance selective between coins. The shape of the damped wave envelope can also be changed in several ways including ways that make it relatively easier to identify and distinguish between envelopes that represent relatively small differences between objects such as between similar coins. The ability to be able to amplify or increase differences in the shape and/or other characteristics of the damped waves provides a tool for improving the ability to be able to distinguish between similar, but different, objects.

The present construction also enables the use of damped waves of relatively short total time duration so that the inductor 20 can be strobed or pulsed at different time intervals or rates including at relatively frequent time intervals as desired. By being able to do this, several coils can be placed in relatively close proximity to each other without pulling or locking on one another as can occur when two different oscillator coils are placed near each other.

Another important advantage of the present construction is that it is relatively stable, a condition obtained without requiring a separate or different oscillator circuit for each different output. On the contrary the wave forms that are produced using the same inductor can be measured by counting the number of cycles that exceed a predetermined voltage level, or by measuring its shape or by using a clock to determine the time between the first cycle and a later designated cycle. Also a combination of measurements of these and other parameters can be employed, if desired.

Figure 4:
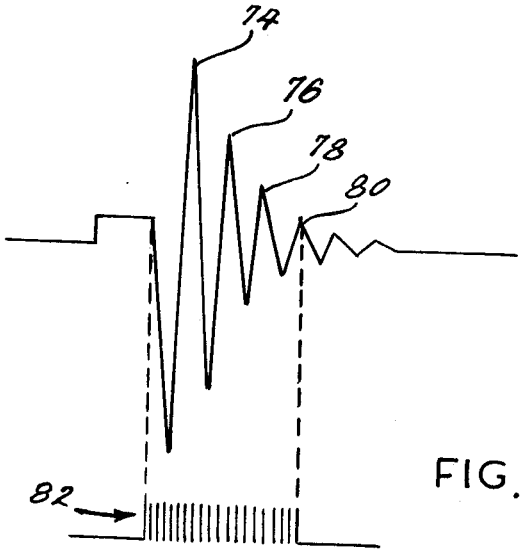
FIG. 4 is a graph of the damped wave form across the inductor for a different frequency condition.

FIG. 4 shows another damped wave produced by a coin present in the field of the inductor. In this case, the first upward excursion or cycle occurs at point 74 and the succeeding upward excursions that exceed the predetermined voltage level 30 are at 76, 78 and 80. FIG. 4 also shows a series of equally spaced clock pulses 82 which occur at a much higher frequency than the frequency of the damped wave. These clock pulses are counted commencing at the beginning of the first cycle of the damped wave and extending until the peak of the last counted cycle 80. Any other beginning and ending points could also be used for this measurement provided they are predetermined for each coin or other specimen to be analyzed. In this way a total final count can be established for a selected number of cycles irrespective of the frequency of the damped wave and irrespective of the predetermined voltage level selected which determines the cycles during which clock pulses are counted. It is important to recognize that each different coin or other object being detected will produce a different output and these outputs can be used to distinguish between coins that may be very similar to each other yet different in some respect. This way of detecting can also be adjusted to provide some latitude of variation to account for normal types of variations that occur between coins of the same denomination such as to account for some wear, and the subject device can also use the same inductor to produce output responses from a variety of coins of different sizes, denominations and metal content. For example, the same inductor can produce responses to distinguish between various U.S. coins as well as between various U.S. and foreign coins such as between U.S. and Canadian coins of the same denominations.

Figure 5:
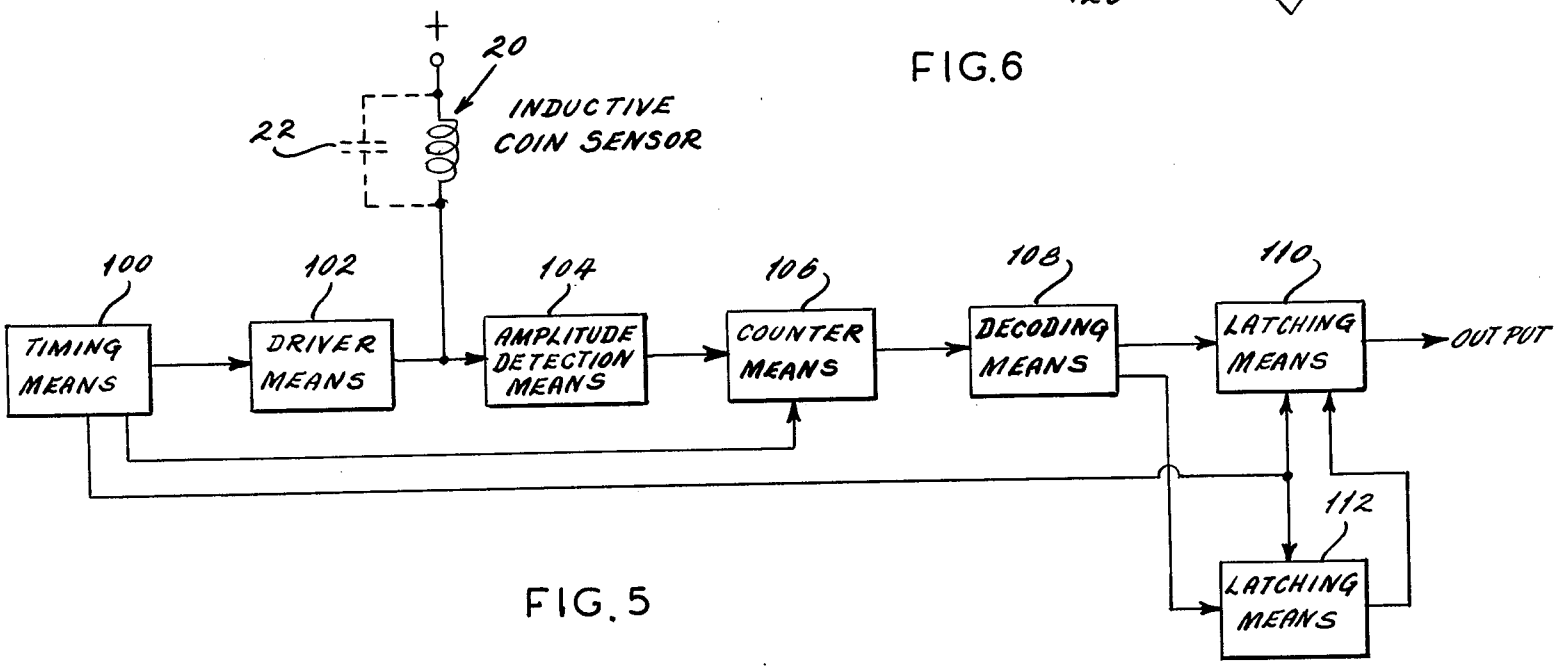
FIG. 5 is a block diagram of a circuit for use with the circuit of FIG. 1 and constructed according to the present invention.

FIG. 5 is a block diagram of a circuit that includes inductive sensor means similar to that shown in FIG. 1. The sensor 20 is connected into the circuit which includes timing means 100 which produces an output that is fed to driver means 102. The driver means 102 are connected to feed an amplitude detection circuit 104 which also has its input connected to the inductive coin sensor 20. Hence the circuit 104 receives a series of short duration damped waves spaced apart in time under control of the timing means 100 and the driver means 102. The output of the amplitude detection means 104 are fed to a counter circuit 106 which also receives control inputs directly from the timing means 100. The counter means 106 produce outputs which are fed to a decoding circuit 108 which in turn feeds two or more latching devices or means such as the latching means 110 and 112. The latching means also receive timed input signals from the timing means 100. The output of the latching means 112 are connected back to the input of the latching means 110 as shown. During an operation a customer will deposit coins into the vending machine and each coin will in turn move through or adjacent to the inductive sensor 20. In so doing each coin will have an affect on the field thereof and will produce a plurality of time spaced damped waves. Keep in mind that as each coin moves down a chute through or adjacent to the conductor 20 it will have an affect on the field of the inductor and thereafter will move out of the field of the inductor. It can therefore be seen that the affect of the coin on the inductor will vary to some extent depending upon where it is in relation thereto. During the time that the coin is moving in the field of the inductor, the timing means 100 and the driver means 102 will periodically interrupt the circuit of the inductor 20 in such a way as to ring or shock the inductor at some predetermined rate. Each time the inductor is rung or shocked a damped wave similar to those discussed above in connection with FIGS. 2, 3 and 4 will be produced and will be applied to the amplitude detection means 104. The rate of the shocking of the inductor is preferably selected so that during the movement of the coin in the field of the inductor many shocks will occur in rapid succession to sample the coins affect on the conductor numerous times. It is therefore important to be able to select or identify those rings or shocks of the conductor which produce damped waves when the coin is in the most advantageous position relative to the field of the conductor 20. In the usual situation, it is possible to ring the inductor numerous times in order to obtain a relatively large sampling of damped waves for selection and use. Each of these damped waves is detected, its cycles counted and decoded in the circuits 104, 106 and 108 respectively. The detection means may include means that select for detecting only those positive (or negative) going cycles of the damped waves that exceed some predetermined value such as explained above in connection with FIGS. 2 and 3. The counter means will then count the number of cycles that exceeds the preselected value and will feed the count thus obtained to the various latching devices or other means such as the means 110 and 112. This will be more fully explained hereinafter. The latching means will then produce an output to indicate either that the coin that was deposited is an acceptable coin or that it is not an acceptable coin, and may include means to direct or deflect each coin to a particular location in the vending machine. Alternatively the counter means can be used to count the number of clock pulses that occur during the period when the excursions of the damped wave exceed the preestablished voltage level.

Figure 6:
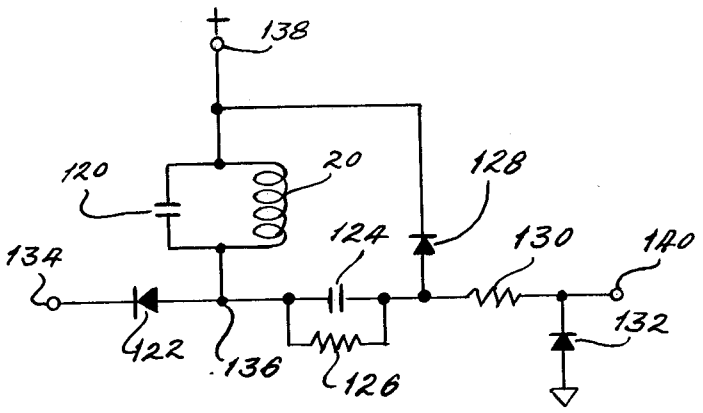
FIG. 6 is a schematic circuit diagram of that portion of the circuit of FIG. 5 in which the inductor is connected.

FIG. 6 shows in even greater detail a particular form of circuit for use with the inductor 20. The circuit as shown in FIG. 6 provides means to modify somewhat the damped waves that are produced as a coin moves in the field of the inductor by modifying the time constant of the circuit associated with the inductor. In FIG. 6 the inductor 20 is shown connected across a capacitor 120 which may be of a predetermined capacitance or may be the distributed capacitance of the inductor 20. One side of the parallel connected inductor 20 and capacitor 120 is connected to a positive voltage source 138 and the opposite side is connected to a first circuit that includes input diode 122, and another circuit formed by parallel connected capacitor 124 and resistor 126. The opposite side of this parallel circuit is connected to one side of another diode 128 which has its opposite sides connected to the positive voltage source 138, and to another resistor 130 which has its opposite side grounded through diode 132. The resistors 126 and 130, the capacitor 124, and the diodes 122, 128 and 132 are all parts of a circuit, the time constant of which affects the rate at which the tank circuit discharges, and this in turn affects the shape of the damped waves that are produced. The time constant is preferably selected to change the initial rate of circuit discharge in order to provide a greater voltage difference between adjacent cycles during the early portion of each damped wave.

If the output of the driver means 102 (FIG. 5) is momentarily sinking, the signal at input 134 of the circuit shown in FIG. 6 will also be reduced toward ground. This will operate to charge the circuit which includes the inductor 20 and the capacitor 120 and means that the circuit at connection 136 will provide a damped wave form beginning as the instant the low voltage is removed from circuit point 134. This rapidly returns the voltage at the input connection 134 to and beyond the potential of the positive voltage source 138.

Figure 9:
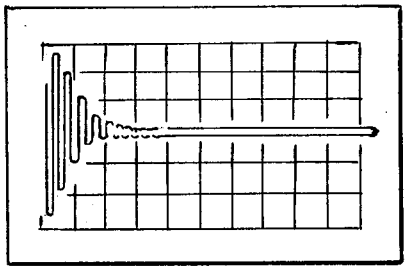
FIGS. 7, 8 and 9 are representative damped wave forms that appear across the inductor of FIG. 6 when three different coin specimens respectively are present in the field thereof.
Figure 8:
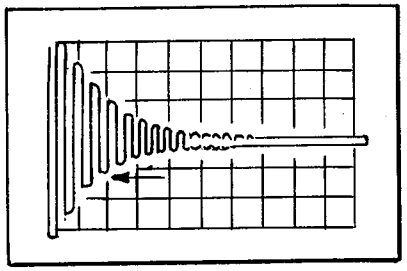
Figure 7:
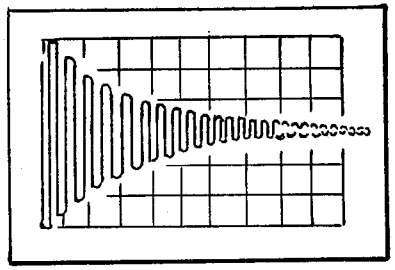

FIGS. 7, 8 and 9 are graphs representative of typical damped wave forms present at the circuit connection 136 in FIG. 6 for three different coin specimens present in the field of the inductor 20. The damping rate of the envelopes as illustrated by the graphs shown in FIGS. 7,8 and 9 vary substantially depending upon the metal content, impedance, and other characteristics of the particular coin involved. For example, FIG. 7 shows a construction wherein the coin reflects a relatively high impedance and therefore produces a relatively slow damping rate. The wave form shown in FIG. 8 is produced by a coin that reflects a relatively lower impedance and therefore the affect on the inductor 20 is greater and the damping rate more rapid. In FIG. 9 the wave form has a still faster damping rate meaning that the coin reflects an even lower impedance. If the frequency of the damped waves in the three instances shown in FIGS. 7, 8 and 9 is maintained the same (which may not be so) then the number of cycles that will exceed some preestablished voltage level will be different in the three cases and these differences can be used to distinguish between them.

The peak-to-peak voltage at the beginning of the damped wave form in a typical situation will exceed the supply voltage by as many as 7 or more times depending upon the Q factor of the circuit involved. The Q factor is the ratio of the reactance of the circuit to the resistance and can be expressed as $Q=2\pi fL/R$. As different specimens or coins are placed in the field of the inductor 20, the inductance and capacitance including the distributed capacitance of the circuit will be changed but the resistance will remain relative unchanged and this will affect the Q of the circuit and the shape of the resulting wave form. Variations in the peak-to-peak voltage of the damped wave, the number of cycles that exceed some value and the frequency of the damped wave can all vary when a coin or other object is present depending on the physical, metallic and electrical characteristics of the specimen. These changes are important and are detected and made use of in the present device to distinguish between different specimens such as between different coins and other objects.

Figure 12:
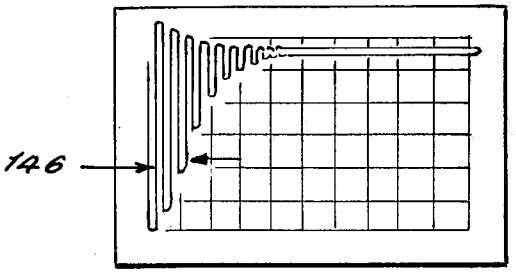
FIGS. 10, 11 and 12 are representative damped wave forms that appear at the output of the circuit of FIG. 6 for the conditions indicated in FIGS. 7, 8 and 9 respectively.
Figure 11:
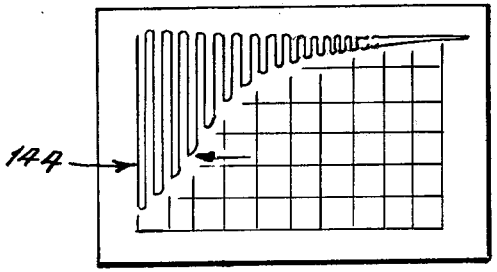
Figure 10:
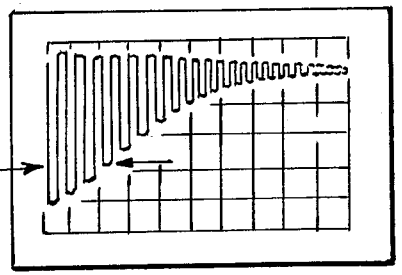

The responses shown in FIGS. 10, 11 and 12 differ somewhat from the corresponding wave forms of FIGS. 7, 8 and 9 and are present at the output terminal 140 of the circuit shown in FIG. 6. The differences between the shapes of the respective wave forms shown in FIGS. 7, 8 and 9 and the signals shown in FIGS. 10, 11 and 12 are due to the particular construction of the circuit as shown in FIG. 6 which modifies the wave forms in the manner shown to make the detection of specific differences more pronounced. In this regard the diode 128 is included in the circuit to clamp any positive going cycles that exceed the potential of the power supply 138. This clamping action causes the capacitor 124 to be charged negatively on its right side as shown in the drawing and positive on its left side at the time that the charge stored on the inductor 20 and capacitor 120 reverses from positive to negative. This produces an algebraic summation of the negative alternations of the damped wave as illustrated by the wave forms shown in FIGS. 10, 11 and 12. This also diminishes the amplitude of the respective wave forms at the slower rate than the corresponding wave forms present at circuit connection 136 as shown in FIGS. 7, 8 and 9. When the potential of the positive alternations or cycles goes below the clamping level of the diode 128, the capacitor 124 does not recharge and the negative going portions of the damped waves therefore diminish at the faster rate at the circuit connection 136. This affect on the damping rate provides an even greater difference in amplitude between adjacent cycles over certain portions of the wave forms and enables still better and more precise selectivity between specimens such as between two or more coins that may be very similar in physical and metallic characteristics.

The output diode 132 and the associated resistor 130 are included in the circuit to clamp out all negative going cycle portions that exceed the clamping level of the diode 132 to ground. It can therefore be seen that the circuit shown in FIG. 6 provides means for increasing the ability of the subject device to be able to distinguish between objects including between objects that may be very similar to each other. This is especially important to be able to do in a device which is designed to distinguish between objects that may have similar physical and metallurgical characteristics.

Figure 15:
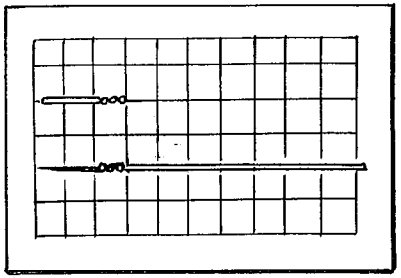
FIGS. 13, 14 and 15 are graphs based respectively on the damped wave forms shown in FIGS. 10, 11 and 12 identifying those cycle peaks of the respective wave forms that exceed some predetermined value.
Figure 14:
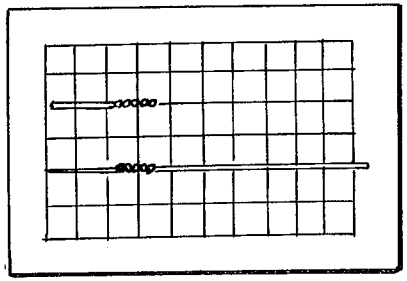
Figure 13:
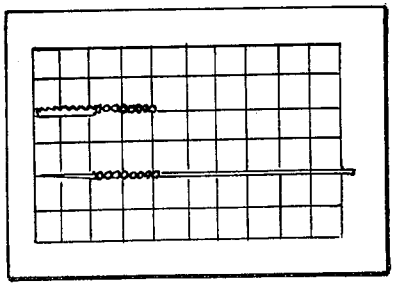

Referring again to FIGS. 10, 11 and 12, the voltage levels designated by arrows 142, 144 and 146 are the preselected voltage levels that are used as the basis for distinguishing between cycles or clock pulses that will be counted and those that will not be counted. FIGS. 13, 14 and 15 illustrate the number of cycles in each case that exceed in magnitude the respective voltage levels 142, 144 and 146 and will therefore be counted. In FIG. 13 there are eight cycles or excursions of the damped wave that exceed the selected voltage level 142, in FIG. 14 there are five cycles or excursions that exceed the voltage level 144, and in FIG. 15 there are three cycles that exceeds the selected voltage level 146. The drawings shown in FIGS. 7–15 are taken from actual graphs appearing on a cathode ray tube and illustrate typical results that can be achieved using the subject detector means.

Figures 16, 17, 18:
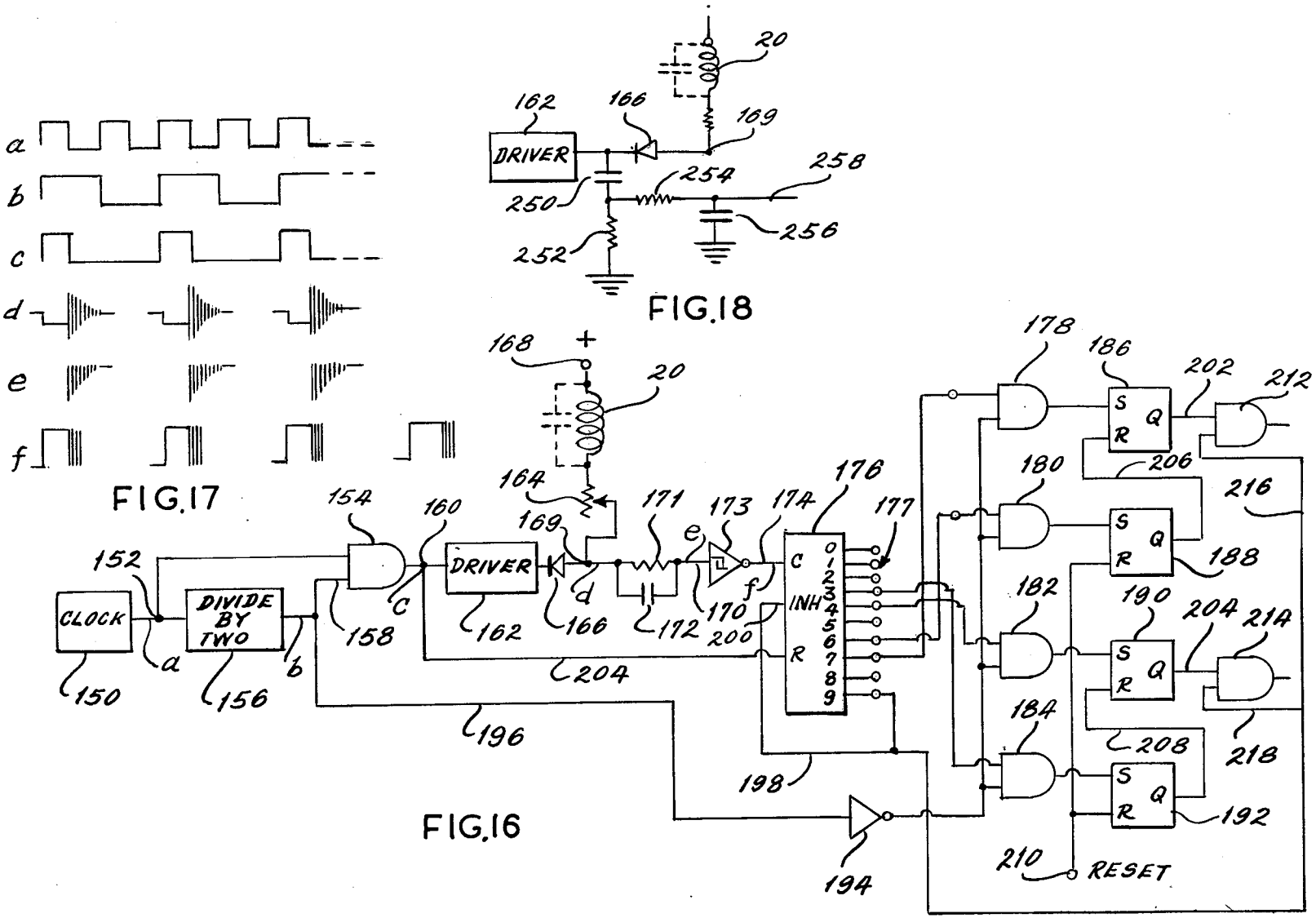
FIG. 16 is a schematic diagram of a circuit embodying the teachings of the present invention using a single inductive sensor connected and positioned to respond to more than one different coin type.
FIG. 17 is a chart showing various signals and wave forms that are encountered in the circuit of FIG. 16.
FIG. 18 is a schematic diagram showing a modified form of the circuit portion associated with the inductor shown in FIG. 16.

FIG. 16 is a more detailed schematic diagram showing a device having a single sensor coil or inductor 20 connected into a circuit and capable of being used to produce damped wave responses that can be used to distinguish between more than one different kind of coin that may be deposited in a vending or like machine. FIG. 17 shows a sequence of voltage wave forms that are present in the circuit of FIG. 16 and their time relationships and these wave forms are identified as wave forms a to f. The locations in the circuit of FIG. 16 where these wave forms occur are so labeled. FIG. 17 also shows the relationship between the various timing pulses and the relative duration of each damped wave, and it shows the number of pulses that exceed some predetermined level that are counted during successive occurrences of the damped waves.

Referring again to FIG. 16, clock 150 provides a basic time data base at circuit location 152 which is applied as one of two inputs to AND gate 154. The same clock signals are applied as inputs to a divide-by-two flip-flop circuit 156, and the outputs of the divide-by-two circuit 156 are applied on lead 158 as second inputs to the AND gate 154. The output of the AND gate 154 at circuit location 160 is applied to a driver circuit 162, and the driver 162 provides the excitation necessary to pulse the inductor 20 which is shown connected thereto through potentiometer 164 and diode 166. The inductor 20 also as a connection to positive voltage source 168 and to ground through a circuit which includes the diode 166 and the driver 162 for the duration of each positive going portion of the input at the circuit location 160, see also wave form c in FIG. 17. This circuit causes the wave forms at the circuit location 169 (wave form d in FIG. 17) to be similar to the wave forms shown in FIGS. 7, 8 and 9. The wave forms in FIG. 16 that correspond to the wave forms shown in FIGS. 10, 11 and 12 occur at circuit location 170 (e) and are the result of the affect of the parallel connected resistor 171 and capacitor 172 and other circuit elements. These signals are applied to and through the level detector 173 and result in wave forms at circuit location 174 (f) which correspond to the wave forms shown in FIGS. 13, 14 and 15. These wave forms are applied as inputs to counter/decoder circuit 176 which has a plurality of outputs 177 labeled 0 through 9. In the construction as shown these outputs individually go high when the number of input pulses accumulated during the occurrence of any damped wave reaches the particular counts or totals as indicated. For example, when the number of pulses reaches 5, the 5 output terminal will go high and so forth for the others. In a typical case involving nickels, the inductor 20 will produce eleven (11) counts when no coin is present therein which is when the inductor is acting as an air core inductor. When a U.S. nickel moves into the field of the inductor 20 the counts produced by succeeding damped waves will be reduced due to the loading effect of the nickel. At first as the nickel enters the field of the inductor the count will be reduced to ten (10), then to nine (9) and so on until, for a genuine U.S. nickel, the final count will reach seven (7) which occurs during those damped wave cycles when the nickel is fully in the field of the inductor. A nickel slug on the other hand, will have a different loading effect and will cause a different count. However, with the present circuit only coins that count to 7 are acceptable and all others whether they produce a count greater than or less than 7 will not be acceptable. In this way, as will be explained later it is possible for the subject circuit to distinguish between a genuine nickel and another coin or slug.

A Canadian nickel, on the other hand, will have a different affect on the inductor than a U.S. nickel and affect the shape of the damped waves produced thereby differently so that the count produced by a genuine Canadian nickel will be 4 in the circuit as shown. All other coins will produce a different final count and will be rejected. Keep in mind that Canadian nickels have different physical, metallurgical and electrical characteristics than U.S. nickels, and therefore produce a different final count. Also, with the circuit as shown it is possible for the same machine to accept genuine U.S. or Canadian coins and reject all others.

Certain of the 0 to 9 outputs 177 of the decoder/counter 176 are connected as inputs to respective AND gates 178, 180, 182 and 184 as shown, and these enable the gates to produce outputs that are applied to respective latching devices 186, 188, 190 and 192. In order for any one of the latching devices 186–192 to be enabled by its respective AND gate there must also be a high on the output of the inverter circuit 194 which has its input connected to the output of the divide-by-two circuit 156 by lead 196. The output of the inverter 194 is connected as a second input of each of the AND gates 178–184. Therefore for one of the AND gates 178–184 to produce an output for energizing its respective latches 186–192 it must simultaneously receive an input from its respective output of the counter/decoder circuit 176 and from the inverter 194. In the form of the circuit as shown and by definition both inputs to any one of the AND gates 178–184 must be the same or in this case high for the AND gate to produce an output.

In the circuit as shown in FIG. 16, the No. 7 output of the decoder/counter circuit 176 is connected as one of the two inputs to the AND gate 178, the No. 6 output is connected as one of the inputs to the AND gate 180, the No. 4 output is connected as one of the two inputs to the AND gate 182, and the No. 3 output is connected as one of the two inputs to the AND gate 184. In a situation where coins are deposited in the vending machine and move through or adjacent to the inductor 20, the number of cycles produced during each occurrence of a damped wave is sensed and when the appropriate count is reached it is applied to the corresponding AND gate and to the corresponding latch. Take the situation where a genuine United States nickel is deposited in the vending machine and produces a low count of 7. This low count which indicates a genuine coin will be applied as an input to the AND gate 178 and to the respective latch circuit 186. This will indicate that the coin is genuine and therefore acceptable. Thereafter, an appropriate entry will be made in the control circuit of the vending or other coin controlled device or machine and used to produce the desired vending, refunding or other functions. If the count for deposit of a coin turns out to be six (6) or if the count never falls below a count of eight (8) instead of seven (7) indicating a non-genuine coin or slug, other controls will take over to prevent making an entry into the vending control circuit.

If on the other hand and when using the same circuit, a genuine Canadian nickel is deposited, the damped wave produced will produce a minimum or count of four (4) instead of seven (7) and this signal will be applied to the gate circuit 182 and to the latch 190. If a slug is deposited for a Canadian nickel and the output count turns out to be three (3) or less instead of four (4) or if the count never gets down to four (4) this will indicate that the coin is unacceptable and no entry will be made. Keep in mind that the same damped wave circuit is used to make both of these determinations and without necessarily requiring a comparison.

In order to understand how the subject device operates it should be remembered that with no coin in the machine the inductor 20 acts as an air core device and this situation produces a relatively high count during succeeding damped waves. In each case, as the coin moves into the field of the coil or inductor the count will decrease due to the loading effect on the inductor circuit and this will continue until the coin is in the most advantageous or centered position in the field when a minimum or low count will be reached. The value of this low count is used as the basis for determining whether a coin is genuine or not, and a coin is only considered to be genuine if the exact final count or range of counts set therefor is achieved. Also during each damped wave a similar test is made and in the usual situation these will occur at a rapid enough frequency so that a number of tests will occur as the coin is moving in or through the field of the inductor. It is also necessary that the decision as to the value of the final count be delayed until after each test is completed. This is achieved in the present device by providing the connection 198 between the nine (9) output terminal of the decoder/counter 176 and the inhibit input 200 thereto.

Obviously, the decoder/counter circuit 176 can have any desired capacity as required, and the specific disclosure of outputs 177 from 0 to 9 is for convenience only. Also, in FIG. 16 the output of the latch circuit 186 is designated 202 and the output of the latch 190 is designated 204. The outputs of the other two latch circuits 188 and 192 are coupled respectively by leads 206 and 208 to the reset inputs of the latches 186 and 190. The latch circuits 188 and 192 also have reset inputs which are connected to a reset input on lead 210. The output 202 of the latch circuit 186 is connected as one input to another AND gate 212 and the output 204 of latch circuit 190 is connected as one input to another AND gate 214. The other inputs to the AND gates 212 and 214 are connected by leads 216 and 218, respectively, to the nine (9) output of the decoder/counter circuit 176. These connections are provided to make sure that the final minimum counts are entered into the decoder/counter 176 before an output is produced for feeding to the vending or other control circuit.

While the circuits shown in FIGS. 6 and 16 use a single inductor, namely, the inductor 20, to produce responses for several different forms or denominations of coins to determine if they are genuine and therefore acceptable, it is apparent that several different inductors similar to the inductor 20 could be used with each of a plurality of circuits similar to the circuit of FIG. 16 to detect an even greater number or variety of coins or for some other reason. If this is done it may require additional timing means to strobe each of the inductor circuits separately and such a device might also require additional latching means depending on the number of possible outputs.

By expanding the number of possible output counts from the counter/decoder circuit 176 and the number of gate and latch circuits associated therewith, it is possible using the same inductor 20 to also greatly expand the capacity of the device. It is apparent therefore, that the subject detection means has wide application and yet provides an extremely accurate and precise way to identify objects such as coins in order to establish whether they are genuine, and to distinguish between genuine and counterfeit coins and slugs.

The circuit of FIG. 16 can also be modified to look at the slope or width of the last pulse of the damped wave that exceeds some predetermined voltage to terminate a counting operation, or make another detection. This is because the last cycle that is looked at will be looked at near its upper limit where it is relatively flat.

FIG. 18 shows a somewhat modified form of the circuit portions most closely associated with the inductor coil 20. The circuit of FIG. 18 may be used with some portions of the circuit shown in FIG. 16 although other possibilities are also available and will be described. One of the main differences between the circuit shown in FIG. 18 and the corresponding circuit portion shown in FIG. 16 is that with the circuit of FIG. 18 there is another circuit connection tied to the circuit between the driver circuit 162 and the diode 166, and the output circuit portions as shown in FIG. 16 may be further modified, substituted for or eliminated. The FIG. 18 circuit includes a blocking capacitor 250 connected in series with resistor 252 to ground, and another series circuit formed by another resistor 254 and a grounded capacitor 256 is connected to the junction between the capacitor 250 and the resistor 252. The output from this circuit, unlike the circuit of FIG. 16, is taken at connection 258 across the capacitor 256. In this circuit the capacitor 250 acts as a D.C. blocking capacitor and the capacitor 256 in conjunction with the resistor 254 acts as an integrating circuit. The ratio of the value of the resistances 252 and 254, establishes the voltage present on the capacitor 256 as compared to the voltage on the non-grounded end of the resistor 252. For example, if the resistance of the resistor 252 is selected to be much larger than the resistance of the resistor 254 then the capacitor 256 will on successive cycles of the damped wave be charged toward some predetermined voltage which will be the established portion of the voltage across the resistor 252. The peaks of the first few cycles of the damped wave will typically be of the order of ten times the D.C. supply voltage and these will contribute most of the charging of the capacitor 256. The output of the circuit as indicated above will appear at circuit location 258 and will be in the form of a stepped voltage formed each time the capacitor 256 is charged by a positive pulse from the damped wave and will discharge but at a slower rate between the charges. In other words, the output voltage at 258 unlike the circuit of FIG. 16 will be a stepped output voltage which like the circuit of FIG. 16 will be representative of the damped wave produced when the inductor 20 is rung. The magnitude of the voltage at the output 258 will depend on the frequency and magnitude of the damped wave cycles and can be used to control various devices similar to but probably different from the decoder/counter circuit 176.

The circuit as shown in FIG. 18 can be adjusted by selecting or adjusting values of the various circuit elements including the resistors and capacitors as well as the inductor 20 so that it generates an output condition which will be distinctive of each ringing or shocking of the inductor. The outputs thus produced can be used to control a device, make an entry in a micro-processor or other similar device, to indicate a voltage level or to operate means to indicate whether a coin or other object meets certain criteria such as certain criteria for acceptability or for some other reason. Many things can enter into the output that is produced at 258 including the frequency of the damped wave produced by ringing of the inductor 20, the magnitude of the damped wave pulses, the degree of damping the charge stored on the capacitor 256, and the characteristics of the circuit itself, including the time constants of the charge and discharge paths. Also the magnitude or relative magnitudes of the voltages present in the damped wave will affect the output. Relatively high voltage cycles occurring at frequent intervals, for example, will tend to charge the integrating capacitor 256 more often and more rapidly than a damped wave of lower amplitude and lower frequency. This is important because it means that there are many possible ways to adjust and control the circuit to be able to produce various possible output conditions, and the output produced by the circuit construction of FIG. 18 also lends itself more readily to analog devices than do the outputs of the circuit of FIG. 16 which are more digital. All embodiments of the present circuit can be used to detect even slight differences between objects or coins and it can do so with extreme accuracy and reliability and by means which are predictable and widely adjustable. Furthermore, the circuit of FIG. 18 does not require a signal modifying circuit portion made up of a parallel resistor and capacitor such as the resistor 171 and the capacitor 172 of FIG. 16, and the circuit of FIG. 18 does not require a decoder/counter circuit or any of the circuit portions connected thereafter as shown. However, the circuit of FIG. 18, like the circuit of FIG. 16, makes use of the distinctive characteristics of damped waves produced when an inductor device is rung or shocked and this is very important. The circuit shown in FIG. 18 therefore provides additional options for the output which are not available for the circuit of FIG. 16. As indicated, the particular construction shown in FIG. 18 performs the same basic function of detecting characteristics of a damped wave as the corresponding circuit shown in FIG. 16 but is not limited to counting cycles that exceed some predetermined value or the cycles produced by a pulse generator or clock, and may not include means to modify the shape of the damped waves produced in order to improve the ability to detect certain characteristics thereof.

Thus there has been shown and described several different forms of a detection device which fulfill all of the objects and advantages sought therefor. It will be apparent to those skilled in the art, however, that many changes, modifications, variations and other uses and applications of the subject detector devices are possible. All such changes, modifications, variations and other uses and applications which do not depart from the spirit and scope of the invention are deemed to be covered by the invention which is limited only by the claims which follow.

What is claimed is:

1. A metal detector comprising a circuit element having inductance and capacitance and circuit means connected thereto, said circuit being capable of producing an oscillating condition, means for repetitively impulsing the circuit elememt to produce a series of timed bursts of oscillations therein the frequency, magnitude and duration of each burst of which depend upon the inductance, capacitance and resistance of said element, means for positioning an object to be detected in the field of said element during the time said circuit element is being repetitively impulsed whereby the bursts of oscillations produced therein are modified as to frequency, magnitude and duration characteristics and differ from the frequency, magnitude and duration characteristics of the element when no object is in the field thereof, which characteristics are representative of the object, and means operatively connected to said circuit element to respond to a particular characteristic of said bursts of oscillations.

2. The detector defined in claim 1 wherein said means responsive to the characteristics of the bursts oscillations include means responsive to the change in the magnitude of adjacent cycles of the burst of oscillations and to changes therein.

3. The detector defined in claim 1 wherein the means responsive to a particular characteristic of the burst of oscillations include means responsive to the damping rate of the burst of oscillations.

4. The detector defined in claim 1 wherein the frequency of the burst of oscillations when an object is positioned adjacent to the circuit element is less than the frequency of a burst of oscillations produced by the circuit element when no object is positioned adjacent thereto.

5. The detector defined in claim 1 wherein the burst of oscillations is in the form of a damped wave envelope the shape and the frequency of which are dependent on characteristics of the object positioned adjacent to said circuit element.

6. The detector defined in claim 1 including circuit means responsive to the frequency of the burst of oscillations produced by the circuit element when an object to be detected is positioned adjacent thereto, said circuit means including an integrating circuit.

7. The detector defined in claim 1 wherein the means responsive to the burst of oscillations include means responsive to the magnitude and frequency characteristics of said burst of oscillations.

8. The detector defined in claim 1 including circuit means responsive to the frequency of the burst of oscillations produced by the circuit element when an object to be detected is positioned adjacent thereto.

9. The detector defined in claim 1 wherein the means responsive to the particular characteristic of the bursts of oscillations include means to establish a predetermined voltage, and means to count the number of cycles of oscillations of the bursts of oscillations that exceed said predetermined voltage.

10. The detector defined in claim 9 including means to produce a first response when the number of oscillations that are counted equals a predetermined count, and means operable in response thereto.

11. A coin detector comprising a circuit element having inductive and capacitive characteristics, means to establish any electric potential across said circuit element, means for applying an electric impulse to the circuit element to produce a burst of oscillations the frequency and duration of which depends upon the resistive and reactive characteristics of said element, means for moving a coin to be detected in the field of said element when an electric impulse is applied thereto to modify the burst of oscillations produced thereby whereby the characteristics of said burst include frequency and amplitude parameters representative of characteristics of the coin, means operatively connected to said circuit element including means responsive to a particular representative characteristics of said burst of oscillations, said means for moving a coin including means to guide the coin along a predetermined path as it moves through the field of the circuit element, and means to generate a plurality of time-spaced electric impulses including means to apply said impulses to said circuit element to produce a corresponding number of bursts of oscillations therein during the time that the coin is being guided through the field of the circuit element.

12. The coin detector defined in claim 11 wherein the burst of oscillations produced when a coin is in the field of the circuit element has a characteristic damped wave envelope form, the shape of which depends at least in part upon the electrical characteristics of the coin.

13. The coin detector defined in claim 11 including means to count the number of oscillations during succeeding bursts that exceeds some predetermined voltage.

14. The coin detector defined in claim 13 including means responsive to said counting means for producing a first output control signal whenever the number of oscillations that are counted equals some predetermined count.

15. The coin detector defined in claim 13 including a clock circuit for producing output pulses, and means for counting output pulses from said clock circuit during that portion of each burst of oscillations when the magnitude of the oscillations exceed said predetermined voltage.

16. Means to distinguish between signals comprising a tank circuit including an inductor, means to repetitively impulse the tank circuit whereby an electric field formed by a series of time spaced oscillation bursts is formed adjacent to the inductor, means to modify at least one of the time spaced oscillation bursts including positioning a member in the field of the inductor, means to detect a predetermined characteristic of at least the one oscillation burst produced including means to establish a predetermined voltage level and means to count the number of oscillations of the oscillation burst that exceeds said predetermined voltage level, first means operatively connected to said counting means for producing a first output when the number of oscillations counted at least equals a predetermined count, and second means operatively connected to the counting means including means to produce a second output when the number of oscillations counted does not at least equal said predetermined count.

17. The means defined in claim 16 wherein said counting means includes an electric counting device having an input and a plurality of outputs, each of said plurality of outputs corresponding to a different respective count entered into the counting means.

18. The means defined in claim 16 including means to inhibit the counting means from producing an output until after the at least one burst of oscillations being counted has expired.

19. The means defined in claim 16 wherein the means to interrupt the voltage established across the tank circuit include means to interrupt said voltage at spaced time intervals to establish a plurality of time spaced damped waves.

20. The means defined in claim 16 including means to amplify the damped wave.

21. The means defined in claim 16 wherein the number of cycles of the damped wave that exceeds said predetermined voltage level is greater when no member is positioned in the field of the inductor than otherwise.

22. A coin detector comprising a circuit element having inductive and capacitive characteristics, means to establish any electric potential across said circuit element, means for applying an electric impulse to the circuit element to produce a burst of oscillations the frequency and duration of which depend upon the resistive and reactive characteristics of said element, means for moving a coin to be detected in the field of said element when an electric impulse is applied thereto to modify the burst of oscillations produced thereby whereby the characteristics of said burst include frequency and amplitude parameters representative of characteristics of the coin, means operatively connected to said circuit element including means responsive to a particular representative characteristic of said burst of oscillations, and circuit means to modify the shape of the burst of oscillations, said circuit means including resistive and capacitive elements operatively connected in circuit with said circuit element.

23. The coin detector defined in claim 22 wherein the circuit means includes resistive and capacitive elements connected in parallel.

24. The coin detector defined in claim 22 wherein the circuit means include resistive and capacitive elements connected in series.

25. A circuit for detecting and discriminating between objects comprising a reactive element having inductive and capacitive characteristics and connected in circuit so as to be capable of producing an oscillating condition when subject to predetermined voltage changes thereacross, means for impulsing the voltage across said element to produce time spaced oscillation bursts in the element, means for guiding an object to be detected into the field of said reactive element whereby said element produces time spaced bursts of oscillations the magnitude, frequency and duration of which depend upon the capacitive and inductive characteristics of said element and on the characteristics of the object in the field thereof, means to in at least one of the bursts of oscillations when the object is in the field of the reactive element count the number of cycles that exceed some predetermined voltage level, means responsive to a predetermined count to identify acceptable objects, and other means to reject objects that produce counts other than the predetermined count.

26. Means to distinguish between signals comprising a tank circuit including an inductor, means to establish a voltage across the tank circuit whereby an electric field is formed adjacent to the inductor, means to interrupt the voltage establishing means whereby the tank circuit goes into an oscillating condition characterized as being a damped wave, means to modify the damped wave including positioning a member in the field thereof, means to detect a predetermined characteristic of the damped wave produced including means to establish a predetermined voltage level and means to count oscillations of the damped wave that exceed said predetermined voltage level, first means operatively connected to said counting means for producing a first output when the number of damped wave cycles counted equals a predetermined count, second means operatively connected to the counting means including means to produce a second output when the number of damped wave cycles counted does not equal said predetermined count, and circuit means to modify the shape of the damped wave, said circuit means including parallel connected resistor and capacitor elements operatively connected to the tank circuit.

27. Means to distinguish between signals comprising a tank circuit including an inductor, means to establish a voltage across the tank circuit whereby an electric field is formed adjacent to the inductor, means to interrupt the voltage establishing means whereby the tank circuit goes into an oscillating condition characterized as being a damped wave, means to modify the damped wave including positioning a member in the field thereof, means to detect a predetermined characteristic of the damped wave produced including means to establish a predetermined voltage level and means to count oscillations of the damped wave that exceed said predetermined voltage level, first means operatively connected to said counting means for producing a first output when the number of damped wave cycles counted equals a predetermined count, second means operatively connected to the counting means including means to produce a second output when the number of damped wave cycles counted does not equal said predetermined count, and means responsive to the damped wave output of the tank circuit, said means including an integrating circuit formed by series connected resistive and capacitive elements, said capacitive element being connected to be charged by succeeding oscillations of the damped wave, and to discharge between said oscillations whereby a stepped voltage output is produced.

28. Means to distinguish between signals comprising a tank circuit including an inductor, means to establish a voltage across the tank circuit whereby an electric field is formed adjacent to the inductor, means to interrupt the voltage establishing means whereby the tank circuit goes into an oscillating condition characterized as being a damped wave, means to modify the damped wave including positioning a member in the field thereof, means to detect a predetermined characteristic of the damped wave produced including means to establish a predetermined voltage level and means to count oscillations of the damped wave that exceed said predetermined voltage level, first means operatively connected to said counting means for producing a first output when the number of damped wave cycles counted equals a predetermined count, and second means operatively connected to the counting means including means to produce a second output when the number of damped wave cycles counted does not equal said predetermined count, no first output being produced by said first means if the count in the counting means exceeds said predetermined count.

29. Means to distinguish between signals comprising a tank circuit including an inductor, means to establish a voltage across the tank circuit whereby an electric field is formed adjacent to the inductor, means to interrupt the voltage establishing means whereby the tank circuit goes into an oscillating condition characterized as being a damped wave, means to modify the damped wave including positioning a member in the field thereof, means to detect a predetermined characteristic of the damped wave produced including means to establish a predetermined voltage level and means to count oscillations of the damped wave that exceed said predetermined voltage level, first means operatively connected to said counting means for producing a first output when the number of damped wave cycles counted equals a predetermined count, and second means operatively connected to the counting means including means to produce a second output when the number of damped wave cycles counted does not equal said predetermined count, said predetermined count including more than one adjacent count.

30. Means to distinguish between signals comprising a tank circuit including an inductor, means to establish a voltage across the tank circuit whereby an electric field is formed adjacent to the inductor, means to interrupt the voltage establishing means whereby the tank circuit goes into an oscillating condition characterized as being a damped wave, means to modify the damped wave including positioning a member in the field thereof, means to detect a predetermined characteristic of the damped wave produced including means to establish a predetermined voltage level and means to count oscillations of the damped wave that exceed said predetermined voltage level, first means operatively connected to said counting means for producing a first output when the number of damped wave cycles counted equals a predetermined count, and second means operatively connected to the counting means including means to produce a second output when the number of damped wave cycles counted does not equal said predetermined count, any count in the counting means that is less than the predetermined count operating said second means to inhibit operation of said responsive means.

* * * * *

UNITED STATES PATENT OFFICE

CERTIFICATE OF CORRECTION

Patent No. 4,254,857 Dated March 10, 1981

Inventor(s) Joseph L. Levasseur, William A. Seiter & Calvin J. Christensen

It is certified that error appears in the above-identified patent and that said Letters Patent are hereby corrected as shown below:

Column 1, line 29 "any" should be --many--

Claim 1, line 49 "elememt" should be --element--

Signed and Sealed this

*Twenty-third* Day of *June 1981*

[SEAL]

*Attest:*

RENE D. TEGTMEYER

*Attesting Officer* *Acting Commissioner of Patents and Trademarks*